United States Patent [19]

Rambin, Jr.

[11] 4,341,508

[45] Jul. 27, 1982

[54] PUMP AND ENGINE ASSEMBLY

[75] Inventor: Leroy M. Rambin, Jr., Houston, Tex.

[73] Assignee: The Ellis Williams Company, Houston, Tex.

[21] Appl. No.: 44,172

[22] Filed: May 31, 1979

[51] Int. Cl.[3] ..... F04B 23/06

[52] U.S. Cl. ..... 417/426; 417/539

[58] Field of Search ..... 417/238, 426–429, 417/539, 567

[56] References Cited

U.S. PATENT DOCUMENTS

| | | | |
|---|---|---|---|
| 1,596,037 | 8/1926 | Warner | 417/567 X |
| 2,651,258 | 9/1953 | Pierce | 417/426 X |
| 2,821,698 | 1/1958 | Richardson | 417/426 X |
| 3,304,869 | 2/1967 | Blume | 417/429 |
| 3,364,871 | 1/1968 | Wilson | 417/539 X |

*Primary Examiner*—Edward L. Roberts

[57] ABSTRACT

A pump and engine assembly according to the present invention is adapted for skid mounting and incorporates a pair of engines positioned in side to side relationship and having rotary output shafts thereof positioned in substantially parallel relation. A pair of piston type pumps are also positioned in side by side relationship with the fluid ends thereof facing in the same direction and with pump drive shafts arranged in substantially parallel relation with the rotary output shafts of the engines. The pump housing of a first one of the pumps incorporates a pair of shaft receptacles receiving a pair of rotary drive shafts. One of the drive shafts is provided with a pinion gear having meshing gear engagement with the primary gear of the first pump while the second drive shaft extends from opposed sides of the first pump. The second pump is provided with a drive shaft that is adapted to be coupled to the second drive shaft of the first pump. Both drive shafts of the first pump are coupled to respective ones of the output shafts of the engines.

23 Claims, 12 Drawing Figures

PUMP AND ENGINE ASSEMBLY

FIELD OF THE INVENTION

This invention relates generally to engine driven pump assemblies and, in particular, piston type pump assemblies incorporating crank shafts, bull gears and pistons for the purpose of achieving compression of a fluid medium that is being pumped. Even more specifically, the present invention is directed to an engine and pump assembly, allowing a pair of engines mounted in side by side relationship in close proximity to one another to be adapted for driving a pair of pumps that are also positioned in side by side relationship in close proximity to one another. Even more specifically, the present invention is directed to a dual engine and dual pump assembly that is adapted to be positioned in compactly oriented relationship on a relatively small skid thereby enabling the engine and pump assembly to be located in a limited space.

BACKGROUND OF THE INVENTION

In many cases, engine and pump assemblies are mounted on skids that enable the engine and pump assemblies to be easily transported to a desired location and placed into operation with a minimum of labor. Typically, the engines and pumps of a skid mounted engine and pump assembly are fixed relative to skid structure that forms a supporting base therefor. In cases where space for such engine and pump assemblies is critical, for example in the case of oil well drilling rigs and offshore drilling rigs in particular, it is especially desirable to achieve optimum positioning of the engines and pumps on a skid of limited size. It is also considered especially desirable to mount two engines and two pumps on a skid structure where the pumps are to be utilized for the purpose of pumping drilling mud to thus insure that complete circulation of drilling mud will not be lost in the event one of the pumps should fail during service due to malfunction of either the engine or the pump mechanism.

Most pumps that are utilized for the purpose of pumping drilling fluid, typically referred to as mud pumps, are piston energized pump mechanisms incorporating gear driven crank shafts and piston rods that are operative to impart reciprocating movement of the pistons of the pump mechanism. The drive shafts of piston type pump mechanisms are typically oriented transversely to the longitudinal axis of such pump mechanisms and the drive shafts of the mud pumps are oriented in parallel relation with the rotary output shafts of the engines. This allows a direct coupling relationship to be established between the output and drive shafts of the respective pumps and engines.

One arrangement for engine and pump assemblies has been to locate the engines in closely spaced side by side relationship and to reverse one of the pumps relative to the other in order that a directly coupled relationship may be established between the output shafts of each of the engines and the drive shafts of the respective pumps. This manner of engine and pump orientation is not satisfactory because it places the fluid ends of the pumps at opposing sides of the skid and, therefore, it is not possible for personnel to simultaneously inspect the fluid ends of both pumps. Moreover, unless suitable gearing arrangement is provided, the drive shafts of one of the pumps must rotate in opposite direction to the drive shaft of the other pump. In this case, the power stroke of the crank shaft and connecting rod interconnection with the pump piston system may be oriented upwardly in one of the pumps. It is considered disadvantageous to orient the power stroke other than downwardly from the standpoint of operational service life of the pump mechanism.

In some cases, it is necessary to elevate one of the pumps relative to the other in order that an output shaftdrive shaft interconnection may pass beneath the first of the mud pumps in order to achieve operation of the second one of the mud pumps. In this case, one of the engines may also require elevation in order that the output shaft thereof may be properly oriented with respect to the drive shaft of the pump to be connected thereto. Elevation of the engines and pumps on the skid obviously requires the skid structure to be of complex nature, thus increasing the cost of the engine and pump assembly to the point that cost becomes adverse to the commercial feasability of the pumping operation. Another disadvantage that is created when engines and pumps are elevated relative to the skid structure is the overall increase in height of the engine and pump assembly. Obviously, in many cases the overall height of the engine and pump assembly becomes quite critical because of the limited vertical space that is allowable for engine and pump installation.

In many cases, it becomes desirable to move engine and pump assemblies through restricted openings or to place the same in locations where it may not be possible to introduce an entire dual engine and dual pump skid assembly without removing other structure. It is desirable, therefore, to provide a skid mounted engine and pump assembly that may be transported in modular components to a desirable location and may be moved through openings of restricted dimension, after which the modules of the system may be simply interconnected, thereby placing the engine and pump assembly in operation without undue delay.

It is therefore a primary feature of the present invention to provide an engine and pump assembly that incorporates a pair of engines that are interconnected in driving relation with a pair of piston type fluid pumps with the engines and pumps being arranged in efficient, compact relationship on a single level skid structure.

It is also a feature of the present invention to provide a novel engine and pump assembly incorporating a pair of engines and first and second pump mechanisms with the drive shaft of the second one of the pumps being interconnected to one of the engines by means of a drive shaft extending through the first one of the pumps.

It is another feature of the present invention to provide a novel engine and pump assembly wherein each of the pumps is formed to define a pair of drive shaft receptacles and with the first one of the pumps incorporating a pair of drive shafts received within the receptacles while the second pump incorporates a single shaft received within one of the drive shaft receptacles thereof and with the shaft of the second pump adapted for interconnection with one of the drive shafts of the first pump.

It is an even further feature of the present invention to provide a novel engine and pump assembly wherein the drive shaft or shafts of each of the pumps are selectively positionable within selected ones of a pair of drive shaft receptacles provided for each of the pumps.

Among the several features of the present invention is noted the contemplation of a novel pump and engine assembly wherein a pair of piston type fluid pumps are positioned in side by side relationship, each pump incorporating a drive shaft supported pinion gear in driving interconnection with a primary gear of the pump and with the drive shaft supporting the pinion gear being selectively positionable within one of a pair of drive shaft receptacles provided in the pump mechanism.

It is an even further feature of the present invention to provide a novel skid mounted engine and pump assembly whereby each engine and each pump of the skid assembly is mounted on a skid module and the various skid modules may be individually transported to an installation site and subsequently assembled to define an integrated engine and pump assembly.

Other and further objects, advantages and features of the invention will become obvious to one skilled in the art upon an understanding of the illustrative embodiment about to be described and various advantages, not referred to herein, will occur to one skilled in the art upon employment of the invention in practice.

SUMMARY OF THE INVENTION

The present invention is directed to a pump and engine assembly that is mounted on a skid structure enabling the engine and pump assembly to be simply transported and installed by means of a skid support, thereby enabling the same to be placed into service with a minimum amount of installation time. In order to enable the development of a dual engine and dual pump engine and pump assembly, a pair of engines are mounted in side by side relationship on the skid structure and rotary output shafts of the engines are positioned in generally parallel relationship and are oriented in a common direction. A pair of piston type fluid pumps are also positioned in side by side relationship on the skid structure with the longitudinal axes thereof disposed in substantially normal relation to the axes of the output shafts of the engines. Such orientation of the pumps, with the fluid ends thereof each visible from one side of the skid structure for simultaneous inspection by service personnel, causes the drive shafts of the pumps to be oriented in substantially parallel relation with the output shafts of the engines.

The first one of the fluid pumps incorporates a pair of drive shafts that are each interconnected by means of a suitable power transmission system to the output shafts of respective ones of the engines. One of the drive shafts of the first pump is provided with a pinion gear that meshes with the primary gear or bull gear of the first pump and therefore imparts rotary motion to the bull gear and the crank shaft to which the bull gear is connected. The second drive shaft of the first pump is rotatably supported by the housing structure of the first pump mechanism with both extremities thereof being exposed on opposed sides of the housing structure of the first pump.

The pump housing structure of the second pump is formed to define a pair of drive shaft receptacles, with only one of the receptacles being provided with a drive shaft and bearing assembly. The drive shaft of the second pump is provided with a pinion gear that establishes meshing, gear driving relationship with the primary or bull gear of the second pump so as to provide power for the second pump through the drive shaft, pinion and bull gear interconnection. The drive shaft of the second pump is adapted to be positioned in substantially axially aligned relation with the second drive shaft of the first pump and is coupled therewith by means of a simple coupling device that connects the second drive shaft of the first pump and the drive shaft of the second pump in driving relationship. The drive shaft of the second pump may be selectively positioned at either of the drive shaft receptacles defined by the pump housing and, in either case, establishes meshing gear driving relationship between the pinion gear and bull gear of the pump. Thus, depending upon the selective position of the first and second drive shafts of the first pump, the shaft of the second pump may be selectively positioned so as to be driven by energy transferred through the second drive shaft of the first pump.

Driving interconnection between the first and second drive shafts of the first pump and respective ones of the rotart output shafts of the engines is established by means of appropriate one to one rotary energy transfer mechanisms. If desired, simple one to one chain drive systems may be employed to establish driving interconnection between respective ones of the output shafts of the engines and respective ones of the first and second drive shafts of the first pump.

It is also within the scope of this invention to utilize the drive-through concept hereof for accomplishing driving of a second pump by means of a driving interconnection between the drive shafts of the pumps. In each case the pumps incorporate drive shafts having at least one of the extremities thereof projecting from each side of the respective pump housings. A drive-through shaft is incorporated into one of the pump housings and is coupled in any suitable driving relation to the drive or pinion shafts of each of the pumps. Chain drive systems of other suitable driving means may be utilized to establish a driving relation between the drive-through shaft and one or more of the pinion shafts. The pumps may be oriented in any suitable manner with respect to one another and the power source.

The skid structure may be defined by a plurality of skid modules, each supporting one of the major components of the engine and pump system. The skid modules may be moved easily through restricted openings and subsequently joined to place the engine and pump assembly in operation with a minimum of delay. Moreover, skid modules may be replaced as necessary to maintain the operational integrity of the engine and pump assembly.

BRIEF DESCRIPTION OF THE DRAWINGS

In order that the manner in which the above-recited advantages and objects of the invention are attained and can be understood in detail, more particular description of the invention, briefly summarized above, may be had by reference to the specific embodiment thereof that is illustrated in the appended drawings, which drawings form a part of this specification. It is to be understood, however, that the appended drawings illustrate only a typical embodiment of this invention and therefore are not to be considered limiting of its scope, for the invention may admit to other equally effective embodiments.

In the Drawings.

DETAILED DESCRIPTION OF PREFERRED EMBODIMENT

Figure 1:
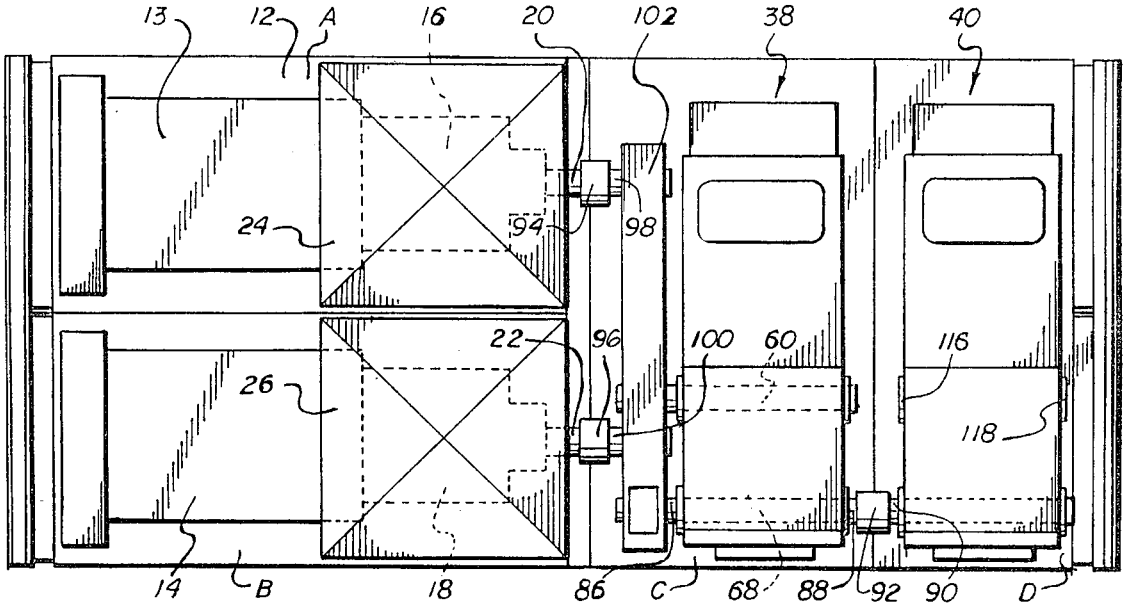
FIG. 1 is a schematic plan view of a skid mounted engine and pump assembly utilizing pumps constructed in accordance with the present invention.

Referring now to the drawings and first to FIG. 1, a skid mounted pump and engine assembly is illustrated generally at 10 and incorporates a skid structure 12 that defines a support base for engines, pumps and other apparatus that enables the pumping of fluid by the pumps.

For purposes of simplicity, the engines are shown as typical internal combustion engines having rotary output shafts and the pumps are shown and discussed herein particularly from the standpoint of piston energized pump systems such are typically employed for pumping liquid under high pressure. It is not intended to limit the present invention to utilization of internal combustion engines, nor is it intended to restrict the invention specifically to piston type pumps mechanisms, it being within the spirit and scope of the present invention to employ other power and pumping systems as well.

A pair of internal combustion engines 13 and 14 are shown to be mounted upon the skid structure 12 in closely spaced, side by side relationship. The engines 13 and 14 incorporate transmission systems 16 and 18 having rotary output shafts 20 and 22, respectively. The particular engine and pump assemblies typically are employed for the purpose of high pressure pumping of drilling fluid, typically referred to as drilling mud, and, the engine pump and skid structure will typically incorporate a pair of liquid tanks 24 and 26 that provide a supply of drilling mud. Typically, the tanks 24 and 26 are elevated on the skid structure 12 by means of support legs such as shown at 28 and 30 and a platform structure 32 rests upon a platform support structure 34, thus providing a work platform for use by pump service personnel. A guard rail structure 36 is also typically provided to provide safe working conditions for the service personnel. For purposes of clarity, the platform is illustrated in broken line, allowing the pump and transmission structure to be shown in full line.

Figure 2:
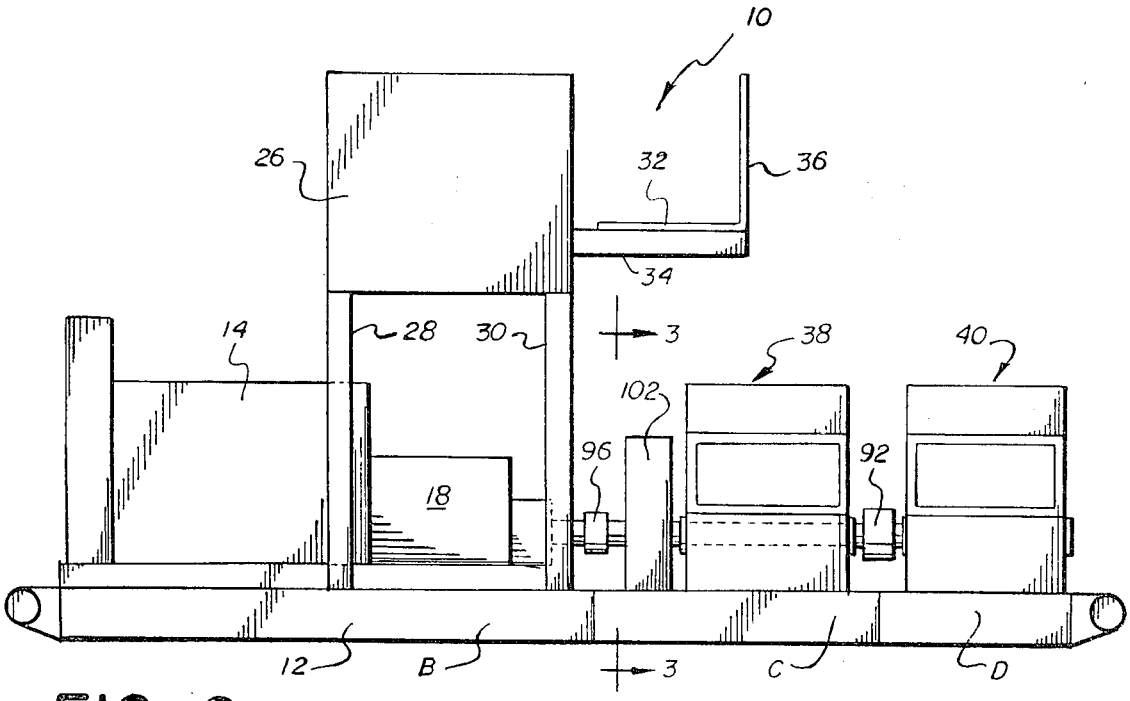
FIG. 2 is a schematic elevational view of the skid mounted engine and pump assembly of FIG. 1.

As mentioned above, it is desirable to locate skid mounted pumps in side by side relationship in such manner that the fluid ends thereof face in a single direction enabling service personnel to simultaneously inspect the fluid ends of the pump mechanisms. It is also desirable that such pump mechanisms be oriented in such manner that the crank shaft and connecting rod system that supplies power to the pistons applies the power stroke to the pistons in a downward direction toward the base of the pumps. These features are effectively provided by the present invention. As shown in FIGS. 1 and 2, a pair of piston type high pressure triplex pumps are illustrated generally at 38 and 40 and are connected to the skid structure 12 in any suitable manner. To simplify understanding of the present invention, pump 38 is referred to herein as the "first pump" while pump 40 is referred to as the "second pump." The first pump is illustrated generally at 38 in FIGS. 4 and 5 and includes a pump housing structure 42 that provides appropriate bearing support for a crank shaft 44 that is rotatable within the housing about an axis 46 and induces rotation to eccentric members 48 that are provided for each one of a plurality of bearing and connecting rod members 50. Although the pump mechanism 38 may be provided with only a single bearing and connecting rod structure 50 that is adapted to establish driving engagement with a piston, not shown, in most commercial pumps for pumping drilling fluid under high pressure, it is typical to employ three bearing and connecting rod assemblies that are driven by eccentric portions of the crank shaft for operation of three pistons provided within cylinders enclosed within the pump housing structure. These types of pumps are typically known as triplex pumps and each of the eccentric structures is positioned in 120° offset relation to one another, thereby positioning the eccentric mechanisms equidistantly about the axis of the crankshaft. The pump mechanism is also provided with a primary gear 52 which is also typically referred to as a bull gear and which is provided with peripheral gear teeth 54 having gear meshing engagement with gear teeth 56 of a pinion gear structure 58. The pinion gear teeth 56 may be formed on an enlarged intermediate portion of a first drive shaft 60 having one extremity 62 thereof extending through the side wall structure 64 of the pump housing 42. Drive shaft 60 is suitably mounted relative to side wall structures 64 and 66 of the pump housing by means of bearing and lubricant seal assemblies like those in FIG. 8 for shaft 68.

Figure 4:
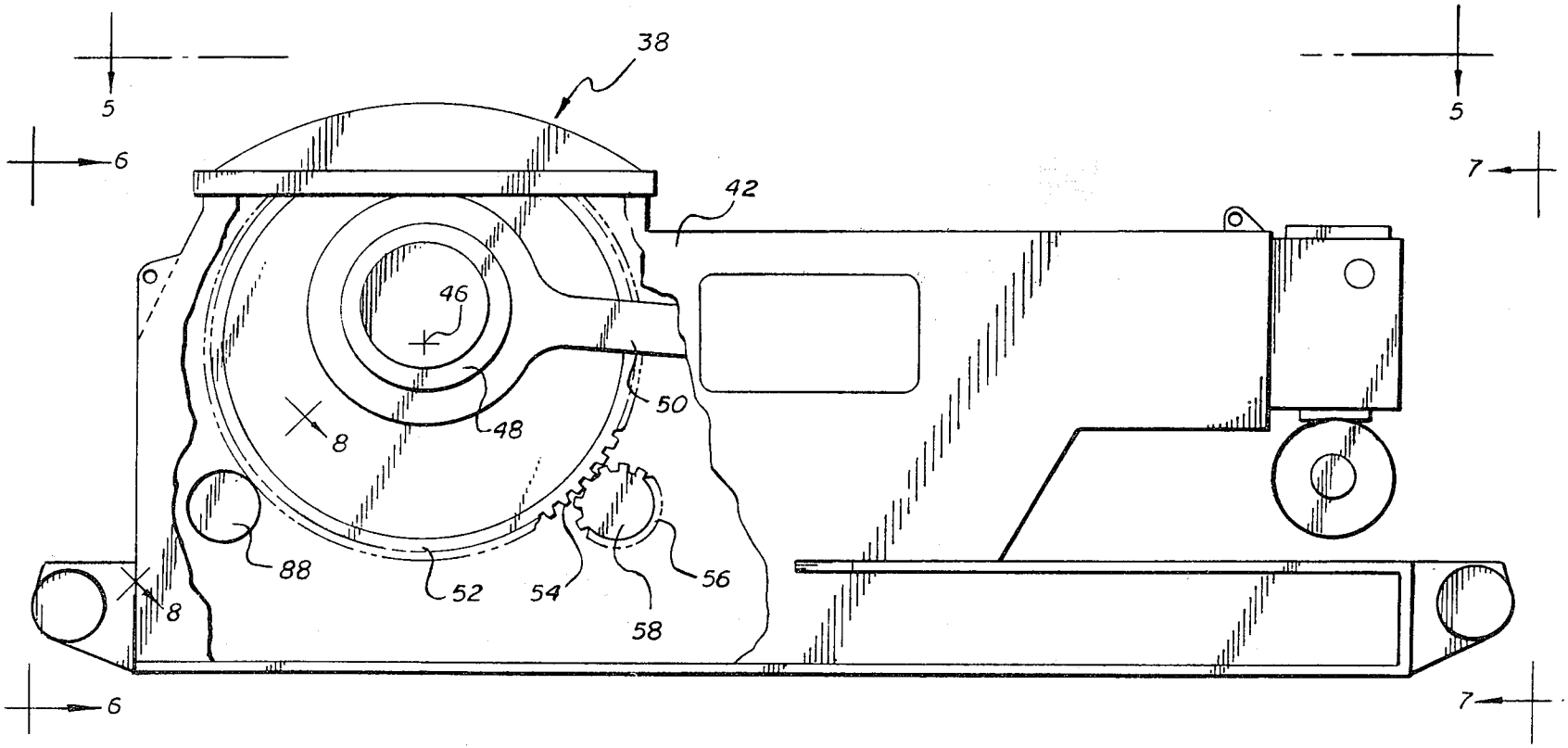
FIG. 4 is a side elevational view of a pump such as illustrated in FIGS. 1 and 2 and having a portion thereof broken away and illustrating the drive shaft and gear arrangement of the first pump mechanism in detail.

Rotation of the drive shaft 60 by a power source coupled to the extremity 62 thereof causes consequent rotation of the pinion gear structure 58 and thus induces rotation of the primary or bull gear 52 which induces rotation of the crankshaft 44 to drive the pistons by means of the crank shaft, eccentric and connecting rod arrangement that is typical to such pumps and shown in FIG. 4.

Figure 5:
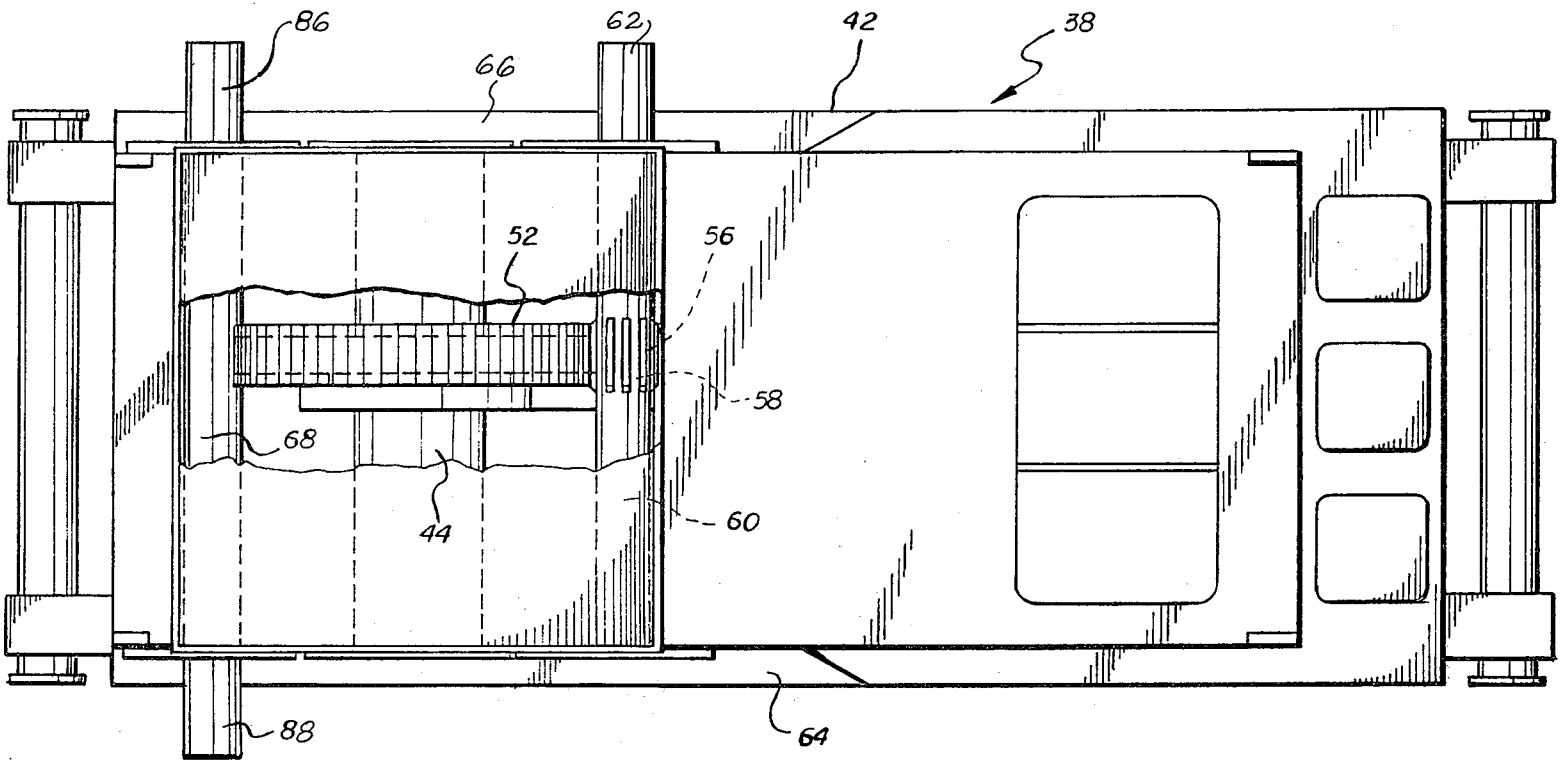
FIG. 5 is a plan view of the pump mechanism of FIG. 4 having portions thereof broken away and illustrating the drive shaft and gear arrangement thereof in broken line.
Figure 8:
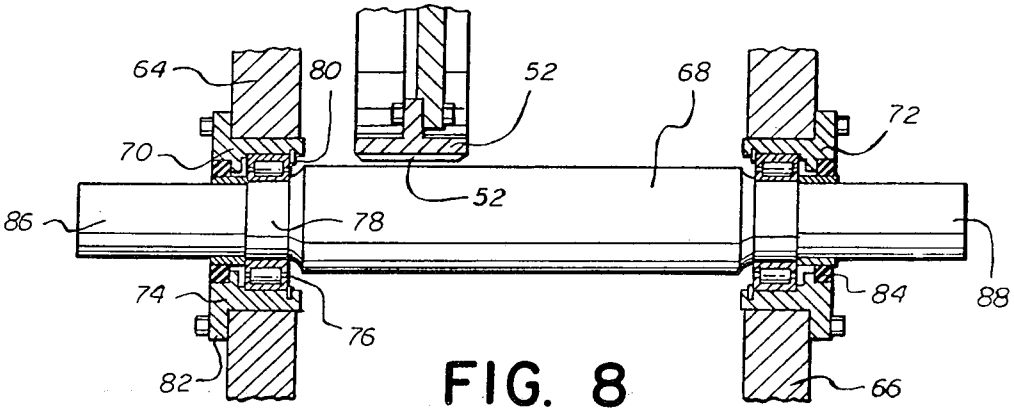
FIG. 8 is a fragmentary sectional view of the pump structure taken along line 8—8 of FIG. 4 and illustrating the second drive shaft and bearing support assembly of the first pump and its relation to the bull gear.
Figure 7:
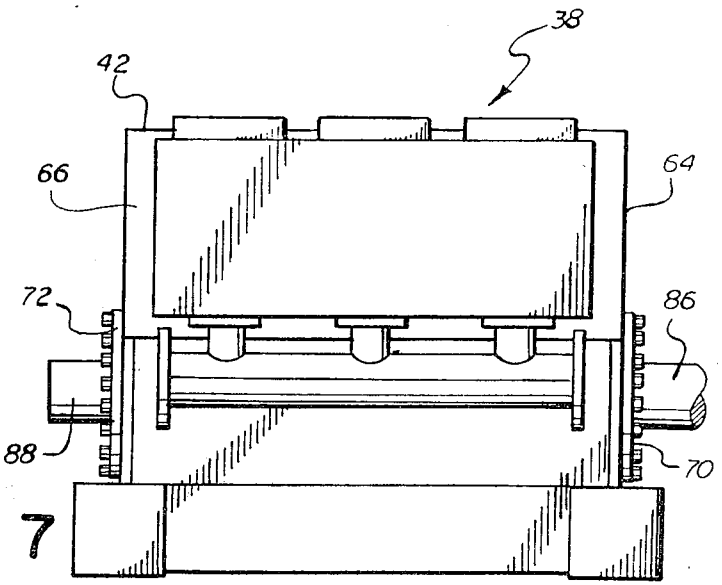
FIG. 7 is an end view of the pump mechanism of FIGS. 4 and 5 taken along lien 7—7 of FIG. 4.
Figure 6:
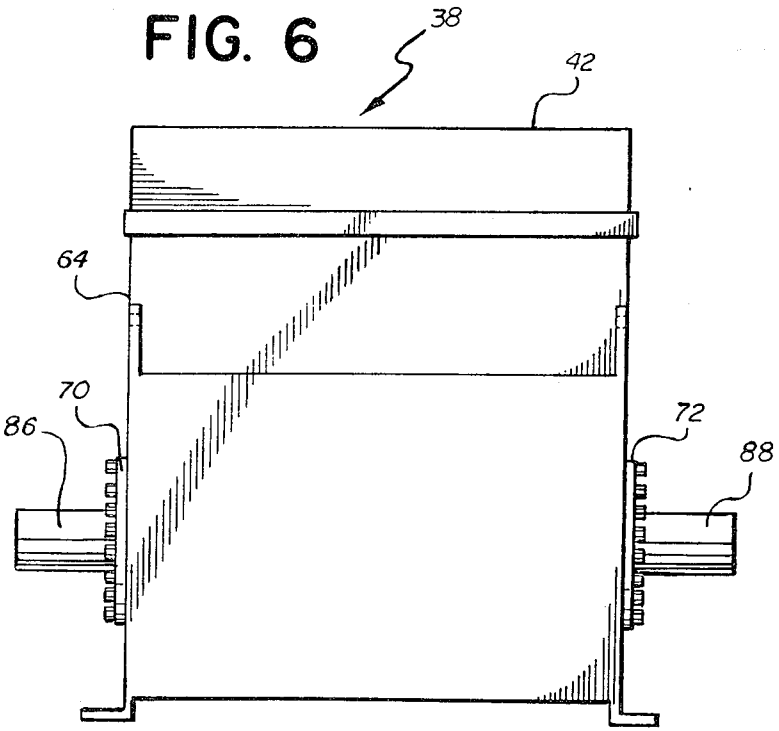
FIG. 6 is an end view of the pump mechanism of FIGS. 4 and 5 taken along line 6—6 of FIG. 4.

It is desirable to mount the second pump mechanism 40 at the same elevation as the first pump 38 and to provide for simple driving connection between one of the engines and a drive shaft of the second pump. In accordance with the present invention, this feature is effectively accomplished by providing the first pump mechanism with a second drive shaft that may be interconnected both with the drive shaft of the second pump and with the rotary output shaft of one of the engines. As shown in FIGS. 4, 5 and 8, a second drive shaft 68 is rotatably supported by bearing structures 70 and 72 by side walls 64 and 66 of the pump housing structure 42. As shown at the left hand portion of FIG. 8, each of the bearing structures incorporates a bearing retainer element 74 adapted to receive a roller bearing 76 therein having an inner bearing race that receives a bearing portion 78 of the second drive shaft 68. A snap ring 80 or any other suitable retainer device is provided for retaining the roller bearing 76 in appropriate assembly with the bearing retainer 74. The bearing retainer structure is formed to define an outer flange portion 82 through which bolts may extend for the purpose of establishing bolted interconnection of the bearing retainer to the wall structure of the pump housing. As shown at the right hand portion of FIG. 8, each of the bearing retainers is formed to receive a lubricant seal element 84.

With the second drive shaft 68 positioned in the manner illustrated in FIG. 8, it should be borne in mind that a driving engagement between the drive shaft 68 and the bull gear 52 is not established. Rather, the drive shaft 68 merely extends through the housing structure, is supported for efficient low friction rotation by the roller bearing assemblies 70 and 72. Further, extremities 86 and 88 of the second drive shaft 68 extend from the housing structure in such manner as to allow efficient coupling of the second drive shaft to other rotatable structures. For example, shaft extremity 86 may be coupled in driven relationship to the output shaft of one of the engines by means of a suitable energy transmission system as will be discussed hereinbelow. The opposite extremity 88 of the second drive shaft 68 also extends beyond the housing wall structure 66 and may be coupled in driving relationship with the drive shaft of the second pump mechanism 40. This feature allows one of the engines to accomplish driving of the second pump mechanism by means of a drive shaft that merely extends through the first pump mechanism.

As illustrated in FIGS. 1 and 2, the second pump mechanism 40 includes a single drive shaft 90 that is mounted in the pump housing structure in the same manner as drive shaft 60 of FIG. 5. In fact, drive shaft 60 of pump 38 and drive shaft 90 of pump 40 may be interchangeable if desired. Appropriate bearing and seal assemblies are providing in pump 40 to provide for efficient rotatable support of the pump drive shaft 90 in the same manner as disclosed in FIG. 8, with the exception that drive shaft 90 only has one extremity thereof extending from the pump housing structure for interconnection with the extremity 88 of drive shaft 68. A suitable coupling device 92 may be provided for the purpose of establishing nonrotatable driving interconnection between drive shafts 68 and 90.

Figure 3:
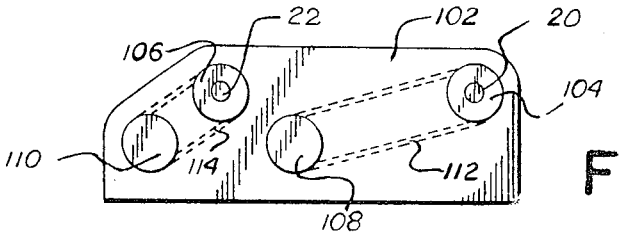
FIG. 3 is a sectional view taken along line 3—3 of FIG. 2 and illustrating a one to one chain drive assembly for establishing interconnection between the output shafts of the engines and the drive shafts of the first pump mechanism.

It is evident that the rotary output shafts 20 and 22 of the engines 13 and 14 are positioned in parallel relation but the spacing thereof is substantially greater than the spacing between the first and second drive shafts 60 and 68 of the first pump mechanism 38. In order to establish driving interconnection between the output shafts of the engines and the drive shafts of the first pump, a simple power transmission may be utilized in the manner shown in FIGS. 1, 2 and 3. The power transmission may be a drive system of one-to-one ratio or other suitable ratio appropriate to accomplish the intended result. Engine output shafts 20 and 22 may be suitably connected by coupling devices 94 and 96 to shafts 98 and 100 of a power transmission mechanism 102. The power transmission mechanism may incorporate a pair of chain drive sprockets 104 and 106 that are interconnected by the coupling structures 94 and 96 in driving relation with the output shafts 20 and 22 of the engines. Other chain drive sprockets 108 and 110 may be interconnected with the drive shafts 60 and 68 of the first pump mechanism 38. Chain elements 112 and 114 may be employed to drive the sprocket members 108 and 110 responsive to rotation of sprocket members 104 and 106 by the output shafts of the engines. The sprocket elements may be of identical or differing diameter and incorporate an appropriate number of teeth to establish a desired drive ratio relationship that allows the drive shafts of the first pump mechanism 38 to be rotated at the same or differing speed as the output shafts 20 and 22 of the engines.

It may be desirable to selectively position the drive shafts of the pump mechanisms, depending upon the particular manner in which the drive through relationship is to be established between the first and second pumps. Accordingly, each of the pump mechanisms is provided with a pair of appropriately positioned bearing receptacles, enabling bearing assemblies such as shown in FIG. 8 to be interconnected into the side wall structure of the pump housings for the purpose of establishing rotatable support for one or more drive shafts. Moreover, each of the bearing receptacles and bearing assemblies is of identical size and configuration, thereby enabling the various drive shafts to be interchangeable. For example, the first and second drive shafts 60 and 68 of the first pump are of substantially identical size and differ only in that drive shaft 68 is provided with an extension defining extremity 88. Drive shafts 60 and 68 may be interchanged with one another thereby positioning the drive through shaft 68 more toward the center of the pump structure in the event such positioning is desired. In the event it is not desired to employ two drive shafts in the second pump mechanism 40, a pair of cover plates 116 and 118 may be provided for covering the bearing apertures in the event such is desired. This feature enables the pump mechanisms to be interchangeable and further allows selective positioning of the pump mechanisms and selective interconnection of the drive and driven shafts thereof, depending upon the particular design of the installation involved.

In many cases, it is desirable to place an engine and pump assembly such as shown in FIG. 1 in a suitable space within a working environment. In particular, it is sometimes appropriate to install engine and pump assemblies in drilling rigs and, in particular, offshore drilling rigs wherein the allowable space for such installation is extremely restricted. Further, it may be necessary to break the engine and pump assembly down into various components in order to achieve movement of the engine and pump mechanism into the desired space. This often requires a considerable amount of time and therefore adversely affects the commercial nature of the pumping operation involved. Where offshore drilling rigs are concerned, the downtime necessity for installation of replacement engine and pump assemblies can be extremely expensive. It is therefore desirable to provide an engine and pump assembly that may be efficiently broken down into small modules, which modules may be efficiently moved into the space for installation of the same and the modules then may be reassembled within a short period of time to facilitate efficient production. Accordingly, the skid structure of the present invention may be broken down into a plurality of modules which may be referred to as modules A and B, each of which may incorporate a single pump drive engine and a mixing or storage tank for drilling mud or the like. Modules C and D of the skid system are each adapted to provide support for one of the first and second pump devices 38 and 40 and the various apparatus connected thereto. Additionally, skid module C provides support for the transmission system 102. Each of the modules A, B, C and D may be moved individually through relatively small openings to the location for installation and assembly of the pumps and engines may be accomplished quite efficiently and with little down time required. It should be noted that the couplings between the various drive and driven shafts are located at the various joints between the various skid segments. Piping manifold arrangements for the pumps and engine mechanisms may be efficiently provided with quick disconnect type couplings, thereby enabling the skid systems to be very quickly assembled in order that the engine and pump mechanisms may be placed in service with a minimum of down time. In the event a pump or engine should become inoperative, the particular module involved may simply be disassembled and a substitute module installed in order to place the engine and pumping system back in service with limited down time.

Figure 9:
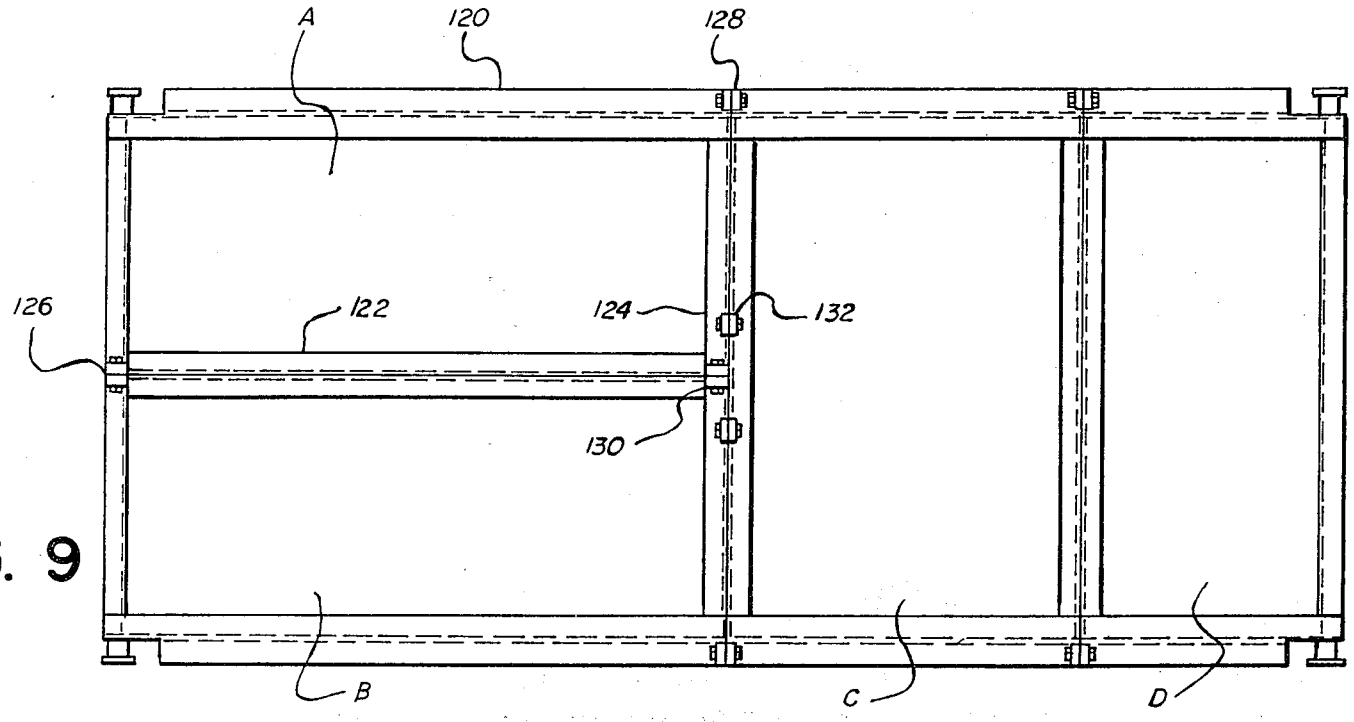
FIG. 9 is a plan view of a modular skid structure constructed in accordance with the present invention illustrating bolted attachment of a plurality of skid segments or modules.
Figure 10:
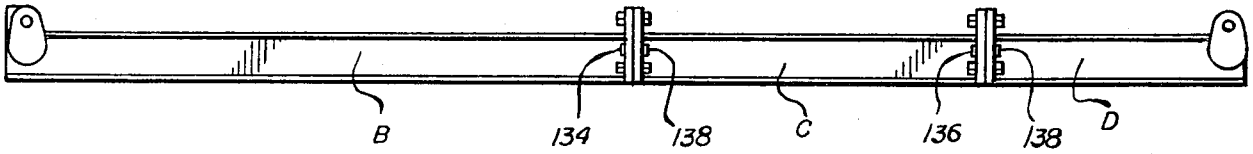
FIG. 10 is a side elevational view of the skid structure of FIG. 9.

The skid structure may conveniently take the form shown in FIGS. 9 and 10 wherein a plurality of skid segments are adapted for bolted interconnection. Skid segment A includes I-beam type structural elements 120, 122 and 124 having upstanding bolt flanges 126, 128, 130 and 132 extending upwardly through the upper flange of the respective I-beams. Other skid segments incorporate similar I-beams and bolt flanges that are adapted for registry with respective ones of the bolt flanges of skid segment A or other skid segments. Bolts may be positioned through bolt apertures in various ones of the bolt flanges to secure the skid segments in assembly. Since all of the bolts are accessible from the deck of the skids, assembly and disassembly of the skid segments is a simple and efficient procedure.

Bolt flanges that are exposed on the sides of the respective skid segments may be brought into alignment by means of drift pins such as shown in FIG. 10 and 134 and 136 that may be driven through apertures in the flanges and may be secured by means of locking elements 138 of any suitable nature.

Figure 11:
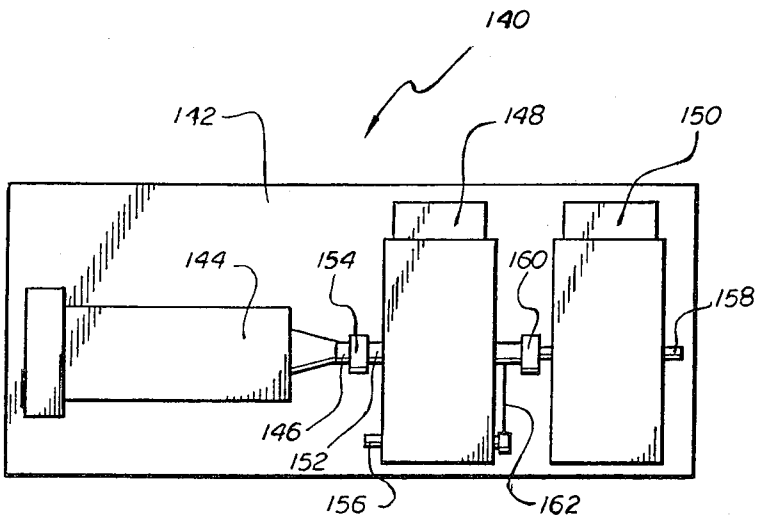
FIG. 11 is a schematic plan view illustrating an alternative embodiment of the present invention wherein the drive-through concept of this invention is employed to drive a plurality of pumps from a single power source.

Referring now to FIG. 11, an engine and pump assembly is illustrated generally at 140 and is shown to be mounted on a skid structure 142, or other suitable support base. A power source 144, which may conveniently take the form of an engine, electric motor, etc. having a rotary output shaft 146, is mounted on the skid structure 142. First and second pump mechanisms 148 and 150 are also mounted on the skid structure and are selectively oriented with respect to one another. Each of the pumps 148 and 150 may be of the general character illustrated in FIGS. 1–8 and discussed above. The first pump 148 includes a housing structure providing rotatable support for a relatively large drive-through shaft 152 having one extremity coupled by means of a suitable coupling 154 to the rotary output shaft 146 of the engine. The opposite extremity of the drive-through shaft 152 also projects from the housing structure of the pump 148.

A pump drive or pinion gear shaft 156 is rotatably supported by the housing structure of the pump 148 and supports a pinion gear, not shown, for the purpose of engaging the bull gear of the pump. Each extremity of the shaft 156 projects from the pump housing.

The second pump 150 also incorporates a drive or pinion shaft 158 that is rotatably mounted relative to the housing structure of the pump and is mounted with both extremities thereof projecting from the pump housing. In the particular pump assembly of FIG. 11, a coupling structure 160 establishes direct driving connection between the drive-through shaft 152 and the pinion shaft 158 of the second pump. To facilitate operation of the first pump 148, a suitable transmission structure 162, such as a chain drive transmission, gear drive transmission or the like, is suitably coupled to one of the projecting extremities of the pinion shaft 156.

Figure 12:
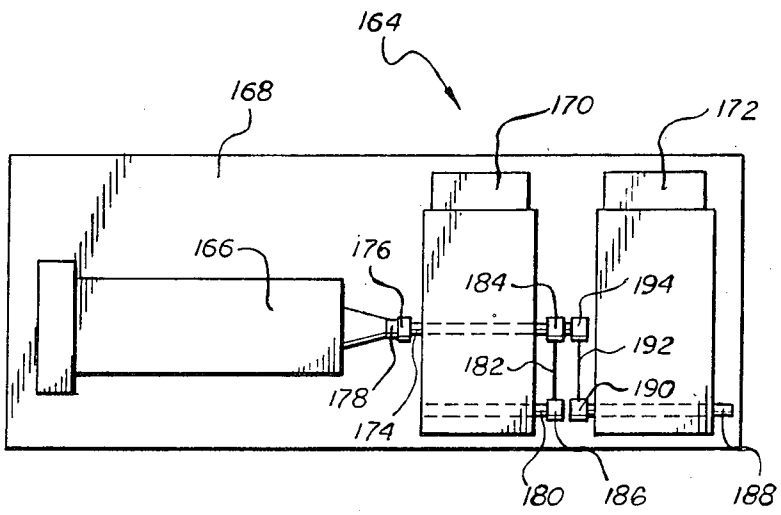
FIG. 12 is a schematic plan view of another alternative embodiment of the invention.

With reference now to FIG. 12, a further modified embodiment of the present invention is illustrated in which an engine and pump assembly illustrated generally at 164 incorporates an engine, electric motor or other power source 166 that is suitably mounted on a skid structure 168. A pair of pumps 170 and 172 are also mounted on the skid structure and the first pump 170 is provided with a drive-through shaft 174 having each of the extremities thereof projecting from the pump housing structure. A suitable coupling device 176 may be employed to establish a driving connection between the drive-through shaft 174 and the rotary output shaft 178 of the engine. The first pump 170 is also provided with a pinion shaft or drive shaft 180 that may be coupled by a suitable transmission 182, such as a chain drive, gear drive, etc., to a coupling device 184 of the drive-through shaft 174 and a coupling structure 186 of the pinion shaft 180. Rotation of the drive-through shaft 174, through the transmission mechanism 182 accomplishes driving rotation of the pinion shaft 180 and thus the pump 170. The second pump structure 172 is also provided with a pinion or drive shaft 188 having the extremities thereof projecting from the housing structure of the pump. One of the extremities of shaft 88 is provided with a suitable coupling 190 that may be interconnected by a suitable transmission device 192, such as a chain drive, gear drive or the like, to a second coupling device 194 supported by the rotatable drive-through shaft 174. Upon rotation of the shaft 174, the transmission devices 182 and 192 impart driving rotation to the shafts 180 and 188 through the coupling devices 186 and 190, respectively.

The pumps 148 and 150, as shown in FIG. 11, and the pumps illustrated in FIG. 12, may be oriented in any suitable manner and the shafts may be positioned as appropriate to achieve proper operation of each of the pumps.

In view of the foregoing, it is clearly apparent that I have provided a novel engine and pumping assembly that allows efficient and compact arrangement of the engines and pumps thereof thereby providing a skid mounted structure that is of minimal overall dimension. Moreover, I have provided an engine and pump system that promotes positioning of the pumps with the fluid ends thereof facing in a common direction, thereby allowing service personnel to simultaneously inspect the fluid ends of each of the pumps. By providing for common direction of rotation of drive shafts of each of the pumps, the power stroke of each of the pumps is accomplished in a downward manner thereby providing for efficient service life of the pumps due to efficient energy absorption and reduced by vibration. The skid structure is of a single height and each of the pumps and engines is mounted directly on the skid structure at a common elevation. Differences in the height of the various shafts is accomodated by means of an effective one-to-one power transmission system. The drive through relationship between first and second pump mechanisms effectively promotes simplicity of design and thereby provides and effective system at minimal cost.

Within the drive-through concept of this invention, it is possible to utilize a single power source, such as an electric motor or an engine, and adapt the power source to drive a plurality of pumps having the drive shafts thereof coupled by simple couplings or transmissions.

It is therefore apparent that the present invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrate and not in any limiting sense.

What is claimed is:

1. A pump and engine assembly for closely spaced engines and rotary driven piston displacement pumps, said assembly comprising:

first and second engines;

a first pump defining a first pump housing;

first and second drive shafts being supported for rotation by said first housing, said first drive shaft being in driving interconnection with said first pump and being coupled in driven relation with said first engine, said second drive shaft having first and second extremities projecting from opposed sides of said first housing, said first extremity of said second drive shaft being coupled in driven relation with said second engine;

a second pump defining a second pump housing; and a second pump drive shaft being mounted for rotation by said second pump housing and being coupled in driving relation with said second pump, said second pump drive shaft being coupled in driven relationship with said second drive shaft of said first pump.

2. A pump and engine assembly as recited in claim 1, wherein:

said first and second drive shafts are interchangeable.

3. A pump and engine assembly as recited in claim 2, wherein:

the position of said drive shaft of said second pump is interchangeable between first and second positions in said housing and is capable of being coupled to said second drive shaft when said second drive shaft of said first pump is interchanged with said first drive shaft.

4. A pump and engine assembly as recited in claim 1, wherein said first and second pumps are reciprocating piston or plunger type pumps and include:

a crank shaft supported for rotation by said housing and driving at least one piston by means of a crank shaft and connecting rod assembly;

a bull gear being interconnected in driving relation with said crank shaft; and said first drive shaft having a pinion gear coupled in driving relation with said bull gear.

5. A pump and engine assembly as recited in claim 4, wherein:

said first and second drive shafts are selectively interchangeable and said pinion gear meshes with said bull gear in either of the positions thereof relative to said housing.

6. A pump and engine assembly as recited in claim 5, wherein:

the position of said drive shaft of said second pump is selectively interchangeable between first and second positions in said second housing and said pinion gear of said drive shaft meshes with said bull gear when said drive shaft is at either of said selective positions.

7. A pump and engine assembly as recited in claim 1, wherein said engine and pump assembly includes:

skid means;

said engine means being mounted on said skid means in such manner that said output shafts thereof are substantially parallel;

said pumps being mounted on said skid means in such manner that said drive shafts thereof are positioned in substantially parallel relation with said output shafts of said engine means; and drive means establishes driving interconnection between said output shafts of said engine means and respective ones of said first and second drive shafts of said first pump.

8. A pump and engine assembly as recited in claim 7, wherein said drive means comprises:

a pair of drive couplings establishing a desired drive ratio therebetween.

9. A pump and engine assembly as recited in claim 7, wherein said drive means comprises:

a pair of chain drives.

10. A pump and engine assembly as recited in claim 7, wherein:

said skid means is defined by a plurality of skid modules capable of being interconnected to define a skid structure;

each of said engine means and said pumps being supported by one of said skid modules during transportation, interconnection of said skid modules establishes proper relative positioning of said engine means and said pumps.

11. A skid mounted engine and pump assembly comprising:

skid means comprising a support base;

first and second engine means mounted on said skid in side-by-side relation, each of said engine means defining a rotary output shaft;

first and second piston displacement pumps mounted in side-by-side relation on said skid means and defining fluid ends each facing in the same direction, each of said pumps having a pump housing, a bull gear being supported for rotation within each said housing and being interconnected in driving relation with a crank shaft and reciprocating piston system;

first and second drive shafts being rotatably supported in spaced, generally parallel relation by said housing of said first pump;

pinion gear means being provided on said first drive shaft and being in gear meshing relation with said bull gear of said first pump;

said second drive shaft having extremities projecting from opposed sides of said pump housing of said first pump, one of said extremities being coupled to said output shaft of said second engine means;

a drive shaft being rotatably supported by said housing of said second pump;

pinion gear means being provided on said drive shaft of said second pump and being in meshing relation with said bull gear of said second pump;

means coupling the other of said extremities of said second drive shaft of said first pump to said drive shaft of said second pump; and means coupling said first drive shaft to said output shaft of said first engine means.

12. A skid mounted engine and pump assembly as recited in claim 11, wherein:

said first and second drive shafts are interchangeable.

13. A pump and engine assembly as recited in claim 12, wherein:

the position of said drive shaft of said second pump is interchangeable between first and second positions in said housing and is capable of being coupled to said second drive shaft when said second drive shaft of said first pump is interchanged with said first drive shaft.

14. A pump and engine assembly as recited in claim 11, wherein said coupling means coupling said output shafts of said engine means to said first and second drive shafts of said first pump comprises:

first and second drive couplings accomplishing shaft driving interconnection.

15. A pump and engine assembly as recited in claim 14, wherein:

said first and second drive couplings are one-toone chain drives.

16. A pump and engine assembly as recited in claim 15, wherein:

said first and second drive shafts of said first pump and said drive shaft of said second pump are rotated in the same rotary direction by said engine means through said first and second drive couplings.

17. A skid mounted engine and pump assembly as recited in claim 11, wherein said skid means comprises:

a plurality of skid modules each adapted to provide support for a modular portion of said engine and pump assembly;

connector means being provided on each of said skid modules and adapted to be positioned in registry with connector means of adjacent skid modules; and means received by said registering connector means for securing said skid segments in assembly.

18. A skid mounted engine and pump assembly as recited in claim 17, wherein said connector means comprise:

a plurality of connector flanges secured to each of said skid modules, said connector flanges being formed to define bolt apertures; and said securing means comprise bolts securing said connector flanges in assembly.

19. A skid mounted engine and pump assembly as recited in claim 18, wherein:

said connector flanges of assembled skid segments extend beyond the upper surface of said skid segments for ready access by personnel for assembling and disassembling said skid modules.

20. A skid mounted engine and pump assembly as recited in claim 17, wherein:

at least some of said connector means are formed to define alignment apertures; and a plurality of alignment pins are received within said alignment apertures and function to position said skid modules in proper registry.

21. A pump mechanism adapted to be driven by power source means through a rotary power output shaft of said power source means for pumping of a fluid medium, said pump mechanism comprising:

a pump housing;

a primary gear being supported for rotation within said housing and defining an outer gear periphery, said primary gear being operatively interconnected with fluid pumping means of said pump;

at least two drive shaft receptacles being formed in said housing along respective centerlines substantially equally spaced relative to said outer gear periphery of said primary gear;

first and second drive shafts and bearing means being supported by said drive shaft receptacles, and secondary gear means being provided on said first drive shaft means and having gear meshing engagement with said outer gear periphery of said primary gear, said first drive shaft means adapted to be coupled for rotation by said power source means; and each extremity of said second drive shaft projecting from said housing, one of said extremities of said second drive shaft adapted for driving interconnection with said power source means, the opposite extremity of said second drive shaft adapted to be coupled to the drive shaft of an adjacent pump, thus adapting said adjacent pump to be driven through said first pump by said power source means.

22. A pump mechanism as recited in claim 21, wherein said each of said drive shafts and bearing means comprise:

a drive shaft;

bearing means supporting said drive shaft for rotation within said pump housing;

one extremity of said first drive shaft is adapted to be coupled to said power source means for rotation thereby; and said first and second drive shafts and bearing means being selectively positionable at either of said drive shaft receptacles with said secondary gear means in driving meshing engagement with said primary gear.

23. A pump mechanism as recited in claim 21, wherein:

said first and second drive shafts being interchangeable within said drive shaft receptacles.

* * * * *